US007036179B1

(12) United States Patent
Weihrauch

(10) Patent No.: US 7,036,179 B1
(45) Date of Patent: May 2, 2006

(54) BRUSH, ESPECIALLY A TOOTHBRUSH

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 518 days.

(21) Appl. No.: 10/088,172

(22) PCT Filed: Sep. 27, 2000

(86) PCT No.: PCT/EP00/09426

§ 371 (c)(1),
(2), (4) Date: Mar. 15, 2002

(87) PCT Pub. No.: WO01/26504

PCT Pub. Date: Apr. 19, 2001

(30) Foreign Application Priority Data

Oct. 14, 1999 (DE) ..... 199 49 671

(51) Int. Cl.
*A46B 9/04* (2006.01)

(52) U.S. Cl. ..... 15/167.1; 15/167.2; 15/168; 15/171

(58) Field of Classification Search ..... 15/167.1, 15/145, 171, 168, 167.2, 186, 188; 401/283, 401/290
See application file for complete search history.

(56) References Cited

U.S. PATENT DOCUMENTS

| | | | | |
|---|---|---|---|---|
| 1,770,195 A | | 7/1930 | Burlew | |
| 2,946,074 A | * | 7/1960 | Caldwell | 401/19 |
| 3,007,441 A | | 11/1961 | Eyer | |
| 3,864,047 A | * | 2/1975 | Sherrod | 401/278 |
| 4,744,124 A | | 5/1988 | Wang | |
| 5,077,914 A | | 1/1992 | Yamamoto | |
| 5,345,646 A | | 9/1994 | Rothweiler | |
| 5,439,014 A | | 8/1995 | Moussa | |

FOREIGN PATENT DOCUMENTS

| | | |
|---|---|---|
| AT | 3 95 807 | 3/1993 |
| AU | 1 67 222 | 11/1950 |
| DE | 17 71 557 | 8/1958 |
| DE | 21 60 719 | 6/1972 |
| DE | 87 02 598 | 7/1987 |
| DE | 39 27 728 | 2/1991 |
| DE | 41 22 524 | 2/1992 |
| DE | 296 20 777 | 3/1997 |
| DE | 196 01 779 | 7/1997 |
| DE | 298 21 819 | 2/1999 |
| FR | 24 73 287 | 7/1981 |
| FR | 27 37 960 | 2/1997 |
| WO | WO 88 01 839 | 3/1988 |

* cited by examiner

*Primary Examiner*—Richard Crispino
*Assistant Examiner*—Abraham Bahta
(74) *Attorney, Agent, or Firm*—Paul Vincent

(57) ABSTRACT

A brush and in particular a tooth brush comprises a brush body and a bristle carrier supporting a plurality of bristles and being preferably removably retained on the brush body. The bristle carrier, consisting of soft-elastic plastic material, is formed as a cap and can be drawn over a projection of the brush body.

29 Claims, 6 Drawing Sheets

BRUSH, ESPECIALLY A TOOTHBRUSH

BACKGROUND OF THE INVENTION

The invention concerns a brush, in particular a tooth brush, comprising a brush body and a bristle carrier supporting a plurality of bristles and being preferably removably retained on the brush body.

The invention is described below, by way of example, as a tooth brush, however, it can be used in the same fashion with other cleaning and application devices having bristles, in particular, washing brushes, scrubbing brushes, cleaning brushes, toilet brushes, brooms, paint brushes, application brushes for creams, powder, cosmetics, medication, spices or paint or even floor treatment brushes, wherein these applications are explicitly included in the invention.

A manual tooth brush of conventional construction comprises a longitudinal brush body made in general of plastic material, whose rear section serves as a handle, and the front head end of which comprises a bristle field having a plurality of bristles fixed to the brush body. An electrically driven tooth brush has essentially similar construction, wherein the brush body is subdivided into a base part accommodating the driving motor and serving as handle, and an attachment part supporting, at its front head, the bristle field and comprising a transmission for converting the motion of an output shaft of the driving motor into an oscillating or back and forth rotating motion of the bristle field.

The bristle field of a tooth brush experiences the largest amount of wear through use. Since worn or bent bristles insufficiently clean the teeth and damage the gums, it is recommended to replace tooth brushes every three months. With conventional tooth brushes of this type, with the bristle field being rigidly connected to the brush body, the bristle body of manual tooth brushes must be entirely replaced when the bristles are worn and the attachment part of electric tooth brushes, including transmission, must be replaced. It has been realized for some time that this procedure is both uneconomical and ecologically questionable.

To prevent these problems, so-called removable head tooth brushes have been developed, wherein the bristle field seats on a removable bristle carrier, in particular in the form of a stable plastic plate which engages in a depression in the head of the brush body, limited by a projecting edge. Since the dimensions of the tooth brush head are limited for handling and application reasons, the edge of the depression reduces the bristle field size. This limitation is acceptable with manual tooth brushes. However, with electric tooth brushes whose bristle field is in any event smaller than that of manual tooth brushes for structural reasons, the bristle field becomes very small which consequently reduces the cleaning effect of the tooth brush.

Moreover, it has been shown that dirt and bacteria can accumulate in the depression and in the gaps between the brush body and the bristle carrier which are difficult to remove such that use of some tooth brushes with removable head is questionable with respect to hygiene.

To securely retain the removable bristle head on the brush body, same has to be sufficiently stable and thus hard which creates the problem that the sensitive mucous membranes come in contact with relatively hard structural parts when using the tooth brush. This could cause injuries.

In conventional tooth brushes, the bristles are usually rigidly held in the bristle carrier. This has the disadvantage that the bristles cannot deflect in the axial direction during cleaning and can deflect in a transverse direction only due to their intrinsic flexibility. When applying large cleaning forces, these forces transferred to the teeth and gums essentially without resilient absorption thereby possibly causing injuries. It has been attempted to dispose the bristle bundles in a resilient fashion on the brush support. However, the construction required therefor is very demanding and requires very expensive production methods.

It is the underlying purpose of the invention to produce a brush of the mentioned type which avoids the above-mentioned problems and which is of simple construction.

SUMMARY OF THE INVENTION

This object is achieved in accordance with the invention in a brush of the mentioned type in that the bristle carrier, consisting of soft-elastic plastic material, is formed like a cap and can be drawn over a projection of the brush body.

In accordance with the invention, the bristle carrier bearing the bristle field is formed as a flexible cap e.g. of an elastomeric plastic material which can be drawn, like a cover, onto a projection, in particular, on the brush body head such that it surrounds and covers the projection and is securely held on the projection by tensioning forces resulting in particular from the elastic deformation of the cap, however, can be removed from same when required. The tensioning or retaining forces of the cap-like bristle carrier are thereby determined by its ability to deform which depends on its geometric design, its wall thickness and the elastic properties of its material.

The inventive cap-like bristle carrier is drawn over the projection and in particular the head of the brush support and is not inserted therein, which has the essential advantage that the surface of the bristle carrier is larger than the surface of the projection overlapping it, such that the bristle field can be relatively large.

The soft-elastic and thus very flexible plastic material of the cap-like bristle carrier can be easily deformed in all directions such that the bristles can resiliently deflect in their axial direction and also perpendicular thereto when cleaning forces are applied.

The cap-like bristle carrier is held on the projection of the brush body by tensioning forces resulting from its elastic deformation thereby preventing formation of gaps between the bristle carrier and the brush body and accumulation of dirt and resulting formation of bacteria.

The cap-like bristle carrier covering the projection of the brush body serves at the same time as mucous membrane protection due to its soft-elastic material and has the further advantage that the constructional height of the brush is small.

A preferred embodiment of the invention provides that the bristle carrier comprises an upper, preferably diaphragm-like covering part having bristles on its upper side and supporting, on its lower side facing away from the bristles, a preferably continuous and peripheral flexible projecting edge or bridge mounted onto the covering part or formed in one piece therewith. The height of the bridge may be constant or also vary along the circumference. In the mounted state of the cap-like bristle carrier, the projection of the brush body is disposed below the covering part and between the peripheral bridge which is tensioned on the projection from the outside. Alternatively or additionally, a bridge may be provided which abuts from the inside on a recess wall in the brush body.

The bristles are disposed at least in partial areas of the upper side of the covering part whose whole surface is preferably provided with bristles. Additionally or alternatively, the bristles may be disposed at least in partial areas of the outer side of the bridge tensioned against the projection from the outside.

In a possible embodiment, the covering part of the cap-like bristle carrier may extend essentially level. The covering part may also have a spatial structure, at least in the mounted state. This can be achieved by providing the upper side of the projection of the brush body with a structured surface and disposing the flexible covering part of the bristle carrier onto the structured upper side of the projection such that it abuts and follows said structure. Therein, the spatial course of the covering part in the mounted state is determined by the surface structure of the projection of the brush body. Alternatively, it is also possible to provide the covering part itself with a structured surface which can be effected either during the production process, e.g. during injection-molding or injection of the bristles or by subsequent deformation, in particular compressing or deep-drawing of the initially flat covering part.

All embodiments may additionally be provided with bristles having differing bristle lengths and/or bristle orientations forming a topographic structure with different heights.

A further preferred design of the inventive brush provides at least one cavity below and/or within the cap-like bristle carrier. This cavity can provide the covering part supporting the bristles with elastic resilience, wherein the resilience is determined by the shape of the cavity and can be adjusted as desired by a damping fluid to be filled into the cavity. Alternatively, the cavity can be used to accommodate a medium to be applied during use of the brush. The medium may either be fluid or powdery cosmetics, tooth care products etc. Supply and application of the medium can be effected e.g. through openings in the flexible cap-like bristle carrier, hollow bristles or bristle bundles or through the capillary effect of bristle bundles.

In a simple embodiment of the cavity, the cap-like bristle carrier can be disposed onto the projection in such a fashion that an intermediate space forming said cavity is generated between the lower side of the covering part of the bristle carrier and the upper side of the projection such that the cavity is limited by the bristle carrier and the brush body.

A preferred further development of the invention provides that a dividing wall divides the cavity into separate chambers which preferably contain media having different characteristics which are mixed and react with one another, optionally, not before leaving the respective chamber. Moreover, the cavity may contain an agent which reacts with an externally applied tooth paste or cleaning cream thereby forming an optimized agent for the intended purpose.

The amount of the medium leaving the cavity or the chambers depends on the deformation of the cavity and in particular of the covering part limiting same.

The cavity or the chambers may be provided with a foamed insert which is inserted either as separate prefabricated part or injection-molded in a multiple-component injection-molding process during production of the cap-like bristle carrier or introduced by foam mold. The foamed insert serves as a damping member for deformation of the covering part supporting the bristles. Moreover, the insert may also be soaked with a medium to be applied. The use of hydrophilic foam allows storage of liquid or gaseous media, contained by said foam, in the cavity. Such enriched foams are easy to handle and, in particular, can be exchanged.

The cavity can be associated with a storage region connected therewith containing a medium to be applied which is supplied, through a passage, to the cavity containing a foamed or sponge insert for throttled and uniformly dosed supply of the medium to the bristle field.

The design of a cavity can also be effected or improved when at least sections of the brush body are formed as cups and the cap-like bristle carrier traverses the cup-like area like a cover. If the brush body as a whole is formed like a cup and is traversed and covered by the cap-like bristle carrier, formation of a very flat brush with an inner cavity is possible which can be filled with a medium to be applied or also charged with cartridges, tablets, filled foamed or sponge inserts.

The resilience of the bristle field is determined essentially by the thickness of the diaphragm-like covering part. The deformation possibilities increase with reduced thickness of the covering part. With electrically operated tooth brushes, a covering part thickness in the range between 0.5 and 3.0 mm has been shown to be reasonable. This has the essential advantage that the overall height of the brush is very low. Deformation of the cap-like bristle carrier and in particular of the covering part can be further adjusted by forming projections and/or recesses on the inner side of the bristle carrier and in particular of the covering part. The projections form reinforcements which impair deformation whereas the recesses define areas which are particularly soft for deformation.

To prevent excessive deformation of the bristle carrier during use and also guarantee that the bristle carrier returns into its initial position without load, the inner side of the bristle carrier may be provided with at least one spring element supported on the brush body. During use, the covering part is deformed against the resilient force of the spring element which, when unloaded, returns the covering part into its initial position. The spring element may preferably be formed by a shackle or bridge fashioned on the lower side of the covering part.

In order to be able to also properly clean inclined surfaces, tilting of the bristle field relative to the brush body is advantageously possible. This can be easily achieved when the bridge is flexible in an axial direction i.e. essentially perpendicular to the covering part and the bristle field. Since the specific elasticity of the bridge is limited, the axial flexibility of the bridge can be assisted when at least sections thereof are formed as bellows.

The bridge, extending on the outside of the projection of the brush body, moreover serves as a protective coating and in particular as mucous membrane protection for the user. Elements may be additionally integrated in the bridge which provide impact protection and which resiliently yield with contact. This can be achieved e.g. in that the bridge comprises elastically deformable projections on its outer peripheral surface which may have the shape of a ring, a loop or a punched tape.

A possible embodiment may provide that the bridge extends in the edge area of the covering part. In an alternative, the covering part may project laterally i.e. radially beyond the bridge thereby forming a freely protruding edge projection. These freely protruding edge sections may be particularly flexible and thus contribute to protective mucous membrane massage. If, during use, a correspondingly equipped brush meets an inclined surface area, the edge section bends relative to the covering part such that the inclined surface area is cleaned simultaneously on both abutting surfaces.

Normally, the tensioning and frictional forces resulting from elastic deformation of the cap-like bristle carrier are sufficient for retaining same securely on the projection of the brush body. It is possible to provide special engagement means for fixing the bristle carrier on the brush body in a non-rotatable fashion. Special engagement means may also be provided to which the bristle carrier is fixed on the brush body in a non-rotatable fashion in the form of e.g. sealing projections provided on the inside of the bridge which engage in corresponding recesses of the brush body thereby providing fixation in a non-rotatable and/or non-lifting fashion. Alternatively, the sealing projections may also be formed on the brush body and the recesses may be formed on the bridge.

The dimensions of the cap-like bristle carrier are adjusted to the respective application. A relatively flat cap may be provided having a covering part with short bridges. However, it is also possible to design the cap-like bristle carrier like a stocking, i.e. for forming a longitudinal cylinder with relatively long bridges as is e.g. required for forming an interdental brush or individual rotating bristle bundles.

The bristles may be pre-fabricated and mounted to the bristle carrier in a conventional fashion. Alternatively, it is also possible to form the bristles in one piece with the bristle carrier and in particular to injection-mold them together using a one-component or two-component method. It is possible to form bristles of different shape, different materials and different orientation on the bristle carrier.

When the cap-like bristle carrier has a cavity, the pressure increase occurring during deformation of the flexible bristle carrier in the cavity can be utilized for actuating an indicator element. The indicator element can e.g. be a displaceably disposed piston which is pushed outwardly when the cavity increases and is retracted into its initial position when the deformed bristle carrier is returned, thereby producing an indication of the pressing force which the user applies to the bristles. Alternatively or additionally, the medium contained in the cavity could change color under pressure to thereby also represent a pressure indication.

The pressure increase in the cavity may also open an outlet valve for a medium to be applied which is contained in the cavity, thereby ensuring that the medium can exit the cavity only upon application of a corresponding pressure by the user.

Deformation of the flexible bristle carrier can be used directly for adjusting an actuating element in that the displacement of partial areas of the wall of the cap-like bristle carrier occurring during deformation is converted directly into adjustment of a mechanical indicator.

BRIEF DESCRIPTION OF THE DRAWING

Further details and features of the invention can be extracted from the following description of embodiments with reference to the drawing.

DESCRIPTION OF THE PREFERRED EMBODIMENT

Figure 1:
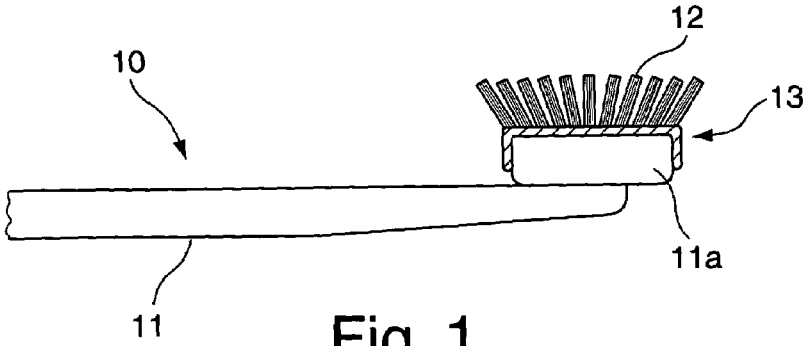
FIG. 1 shows a representation of the front end of a tooth brush with attached cap-like bristle carrier.
Figure 2:
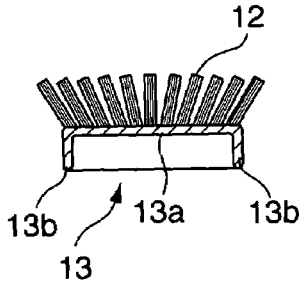
FIG. 2 shows a sectional view of a bristle carrier.

FIG. 1 shows the front part of a tooth brush 10 with a brush body 11 serving as handle comprising, at its front end, a block-like projection 11*a* serving as support. A flexible cap-like bristle carrier 13 is drawn over the projection 11*a* and supports a plurality of bristles 12 on its upper side. FIG. 2 shows that the bristle carrier 13 comprises a flat diaphragm-like covering part 13*a* which supports the bristles 12 on its upper side and comprises, in the edge area on its lower side facing away from the bristles 12, a peripheral bridge 13*b* projecting downwardly. The inner dimensions of the bristle carrier 13 are somewhat smaller than the outer dimensions of the projection 11*a* such that it can be attached to the projection 11*a* under elastic deformation without play. Due to the elastic deformation, the peripheral bridge 13*b* of the bristle carrier 13 stretches over the projection 11*a* from the outside and is securely held thereon.

The bristles 12 may extend parallel or at an angle to one another, wherein in the latter case, they project laterally over the bristle carrier thereby increasing the work surface. Alternatively, it is also possible to bend the bristles individually and/or orient them in different directions or crosswise.

Figure 3:
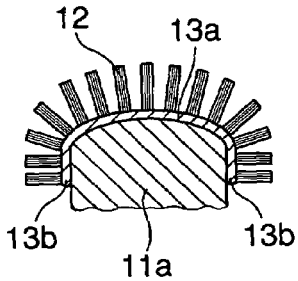
FIG. 3 shows a sectional view of an alternative embodiment of a brush with attached bristle carrier.

While the projection 11*a* represented in FIG. 1 comprises an essentially horizontal surface on which the covering part 13*a* of the bristle carrier 13 is level, in FIG. 3 the surface of the projection 11*a* is convex which gives the covering part 13*a* of the drawn-over bristle carrier 13 a likewise convex shape.

Figure 4:
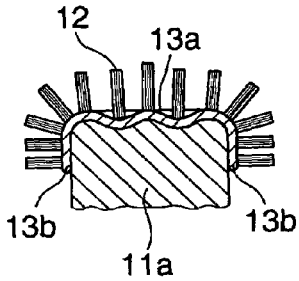
FIG. 4 shows a modification of the embodiment in accordance with FIG. 3.

In accordance with the embodiment of FIG. 4, the covering part 13*a* also follows the surface structure of the projection ha which is wavy in the present case.

Figure 5:
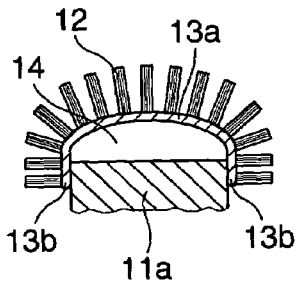
FIG. 5 shows a sectional view of a further alternative embodiment of a brush with attached bristle carrier.
Figure 6:
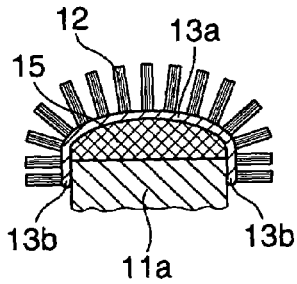
FIG. 6 shows a modification of the embodiment in accordance with FIG. 5.
Figure 7:
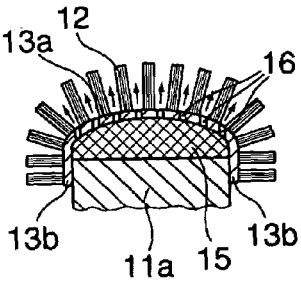
FIG. 7 shows a modification of the embodiment in accordance with FIG. 6.

In accordance with FIG. 5, the covering part 13*a* of the bristle carrier 13 has a convex shape and is disposed at a separation from the surface of the projection 11*a* thereby forming a cavity 14 between the bristle carrier 13 and the projection 11. Upon exertion of external pressure onto the bristles 12, the bristle carrier 13 may resiliently yield towards the inside, whereby the fluid contained in the cavity 14, e.g. air, damps deformation of the bristle carrier 13. In a further development in accordance with FIG. 6, a foamed body 15 can be introduced into the cavity 14 whose specific elasticity damps deformation of the bristle carrier 13. The foamed body 15 may be filled with a liquid or gaseous medium to be applied, wherein the medium may exit through passages 16 (FIG. 7) formed in the covering part 13*a* of the bristle carrier 13.

Figure 8:
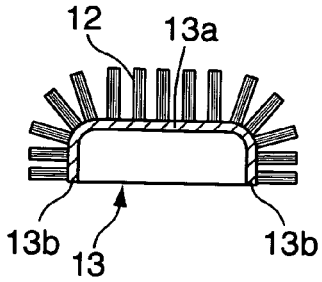
FIG. 8 shows a modification of the bristle carrier in accordance with FIG. 2.
Figure 9:
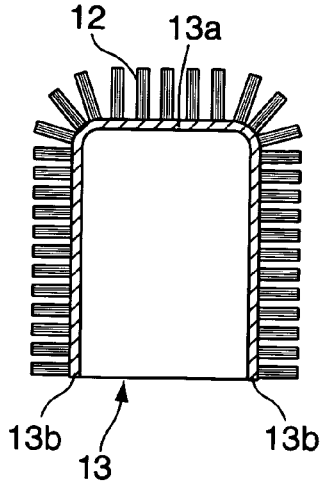
FIG. 9 shows a sectional view of a bristle carrier with a modified geometrical shape.

In the previous embodiments, the bristle carrier 13 is provided with bristles on the upper side of the covering part 13*a* only. FIG. 8 shows an embodiment wherein the outer surface of the bridge 13*b* has also bristles 12. Therein, the bridge 13*b* for forming a longitudinal stocking-shaped hollow body may be relatively long (FIG. 9).

The bristles 12 may be disposed over the entire surface of the outer side of the bristle carrier 13 or only on partial areas thereof. Moreover, the bristles may have identical or different lengths and form, with their tip sections, a covering surface of any topographic shape.

Figure 10:
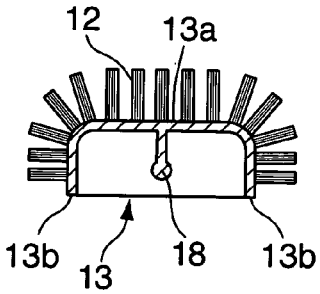
FIG. 10 shows a sectional view of the bristle carrier with reinforcement.
Figure 11:
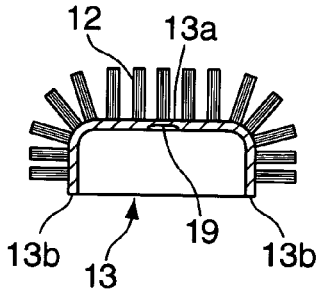
FIG. 11 shows a sectional view of a bristle carrier with a recess.

In the embodiment of the bristle carrier 13 shown in FIG. 10, a projection 18 serving as reinforcement is formed on the lower side of the covering part 13*a* by means of which the deformation characteristics of the covering part 13*a* change with external load and can be adjusted to the desired application. While the projection 18 increases the rigidity of the covering part 13*a*, the covering part 13*a* may also alternatively comprise recesses 19 which reduce the rigidity of the covering part (FIG. 11).

Figure 12:
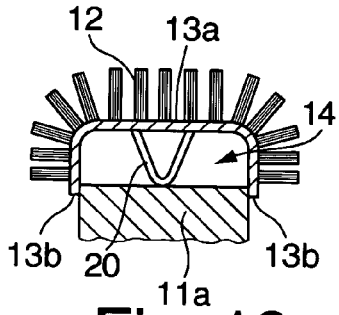
FIG. 12 shows a sectional view of a bristle carrier with spring element.
Figure 13:
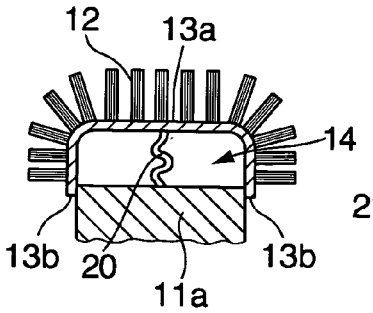
FIG. 13 shows a sectional view of a bristle carrier with an alternative spring element.

In accordance with FIGS. 12 and 13, spring elements 20 are provided or formed on the lower side of the covering part 13*a* which are supported on the upper side of the projection 11*a*. The spring elements 20 are compressed during external loading of the covering part 13*a* and guarantee that the covering part is forced back into its initial position after de-loading. In accordance with FIG. 12, the spring element 20 is formed by a strap-like shackle held at both ends on the covering part 13*a*. In FIG. 13, a double S-shaped support is provided as spring element which is mounted on its upper end to the covering part 13 and is supported with its lower end on the projection 11*a*.

Figure 14:
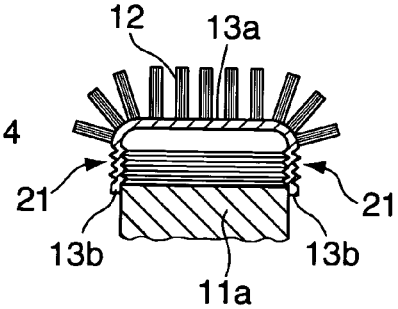
FIG. 14 shows a sectional view of a bristle carrier with a deformable bridge.

In accordance with FIG. 14, the bridge 13*b* of the bristle carrier 13 is formed sectionally as bellows 21 thereby enabling tilting of the covering part 13*a*, having the bristles 12, relative to the projection 11*a* during use without the danger that the bristle carrier 13 slides off from the projection 11*a*. This provides good, resilient support of the bristles, even on an inclined cleaning surface.

Figure 15:
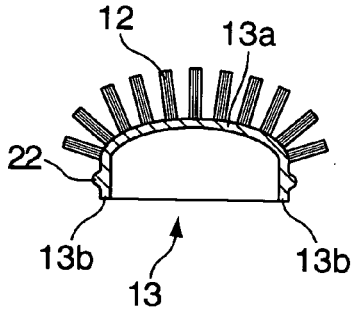
FIG. 15 shows a sectional view of a bristle carrier with lateral protection elements.
Figure 16:
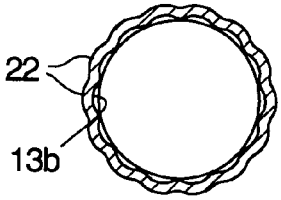
FIG. 16 shows a view from below of the bristle carrier in accordance with FIG. 15.

The bridge 13*b* abutting the side surface of the projection 11 in the mounted state also serves as a protective coating and, in particular in a tooth brush, as mucous membrane protection. FIGS. 15 and 16 additionally provide that the bridge 13*b* comprises, on its outer peripheral surface, elastically deformable projections 22 which are formed by sectionally wavy configuration of the bridge 13*b* in accordance with FIG. 16.

Figure 17:
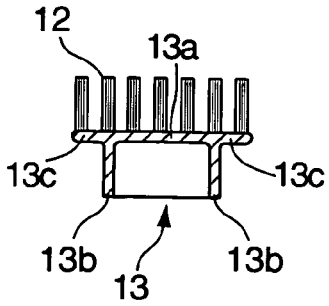
FIG. 17 shows a further alternative embodiment of the bristle carrier in accordance with FIG. 2.
Figure 18:
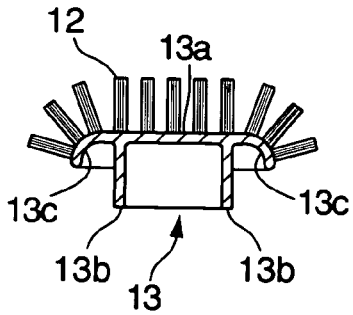
FIG. 18 shows a modification of the bristle carrier in accordance with FIG. 17.

FIGS. 17 and 18 show two embodiments wherein the covering part 13*a* projects laterally or radially outwardly over the bridge 13*b* thereby forming a freely protruding edge section 13*c*. In this fashion, the work surface provided with bristles 12 is increased and, due to the flexibility of the freely protruding edge section 13*c*, they can easily abut on and clean a curved or angled surface. FIG. 18 shows a further development, wherein the outer sections of the freely protruding edge sections 13*c* are bent downwardly thereby forming an outwardly curved, convex section.

Figure 19:
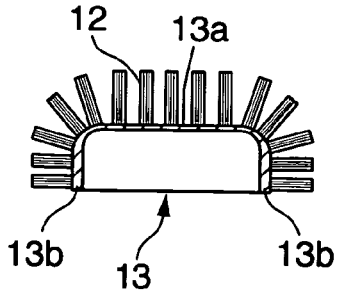
FIG. 19 shows a further alternative embodiment of the bristle carrier in accordance with FIG. 2.
Figure 20:
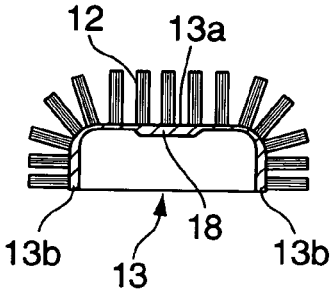
FIG. 20 shows a modification of the bristle carrier in accordance with FIG. 19.

The deformability of the bristle carrier 13 is determined i.a. by its geometric design. To provide the peripheral bridge 13*b*, which essentially has a holding function, with sufficient stability and to simultaneously allow easy deformation of the covering part 13*a*, these two sections may have different wall thicknesses, as shown in FIG. 19. Therein, the slightly stronger bridge 13*b* continuously passes over into the relatively thin covering part 13*a*. To prevent excessive deformation in the central region of the covering part 13*a*, this area may have a larger wall thickness, e.g. a reinforcement 18 as represented in FIG. 20.

Figure 21:
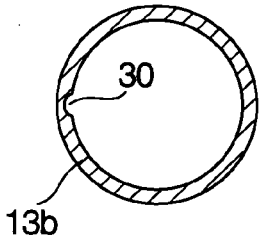
FIG. 21 shows a view from below of a bristle carrier with non-rotational fixation.
Figure 22:
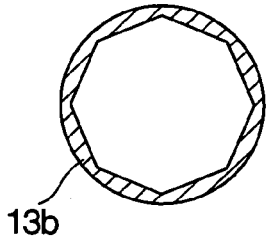
FIG. 22 shows a view from below of a bristle carrier with alternative embodiment of the non-rotating fixation.

To retain the bristle carrier 13 on the projection 11*a* in a non-rotatable fashion, the inner side of the bridge 13*b* is provided with a single recess 30 (shown in FIG. 21), which can engage with a correspondingly formed nose (not shown) of the projection 11*a*. Alternatively and in accordance with FIG. 22, the inner peripheral surface of the bridge 13*b* may be polygonal and, in particular, in accordance with the figure, octagonal and disposed on a corresponding polygonal projection.

Figure 23:
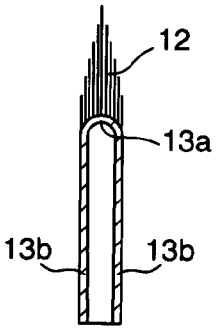
FIG. 23 shows a sectional view of a stocking-shaped bristle carrier.

FIG. 23 shows the bristle carrier 13 as a longitudinal stocking-shaped cylinder with a relatively small covering part 13*b* supporting bristles on its upper side configured in the shape of a triangle. Such a bristle carrier may be used as a bristled cap for interdental brushes or as a removable cap for electric tooth brushes having individual rotating bristle bundles.

Figure 24:
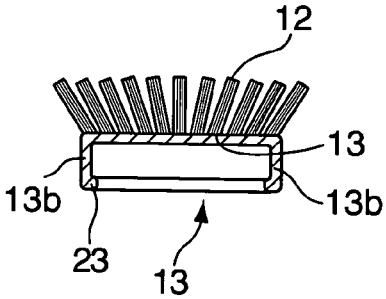
FIG. 24 shows a sectional view of a bristle carrier with engagement fixation.
Figure 25:
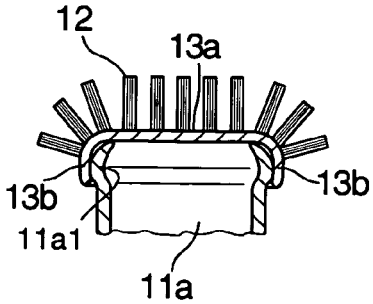
FIG. 25 shows a sectional view of an alternative of a bristle carrier with engagement fixation.
Figure 26:
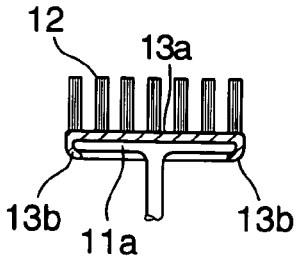
FIG. 26 shows a bristle carrier on a plate-shaped projection.

To secure the cap-shaped bristle carrier 13 on the projection 11*a*, the inner side of the bridge 13*b*, in the embodiment in accordance with FIG. 24, comprises a peripheral inward facing engagement nose 23 which can engage in a correspondingly formed recess of the projection 11*a*. In accordance with FIG. 25, the upper section 11*a*1 of the projection 11*a* is bulged to the outside and is undercut by the bridge 13*b* of the flexible bristle carrier 13. In a further embodiment in accordance with FIG. 26, the projection 11*a* is formed as a plate and is undercut by the bridge 13*b* of the attached cap-like bristle carrier 13.

Figure 27:
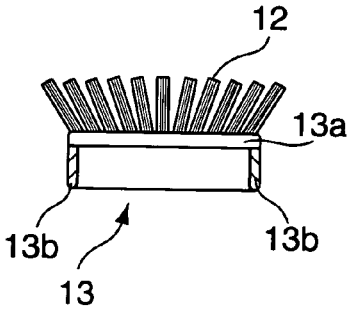
FIG. 27 shows a sectional view of a bristle carrier of several components.
Figure 28:
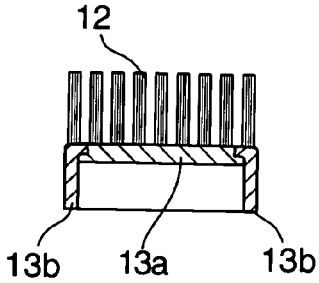
FIG. 28 shows a sectional view of a bristle carrier of several structural parts.

The bristle carrier 13 can be made from one single material. However, FIGS. 27 and 28 show that the covering part 13*a* and the bridge 13*b* can be produced from different flexible plastic materials, in particular via a two-component injection-molding process. In this fashion, the material properties of the individual areas can be well adapted to their required function during use. Alternatively (FIG. 28), the covering part 13*a* and the bridge 13*b* may be pre-fabricated and connected to one another later by welding, gluing, clamping or in any other manner.

Figure 29:
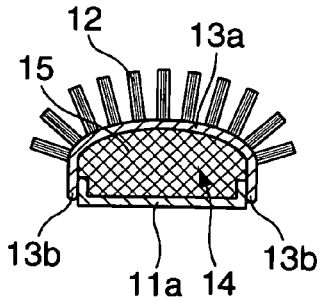
FIG. 29 shows a sectional view of a brush with cap-shaped bristle body.

As mentioned above, a cavity 14 may be formed between the projection 11*a* of the brush body 11 and the cap-like bristle carrier 13. Formation of the cavity 14 is facilitated when sections of the projection 11*a* of the brush body 11 are cap-shaped or when it is entirely formed like a cap, as shown in FIG. 29. A foamed insert is thereby inserted in the cavity 14.

Figure 30:
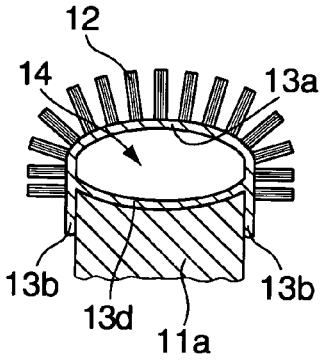
FIG. 30 shows a sectional view of a bristle carrier with cavity.
Figure 31:
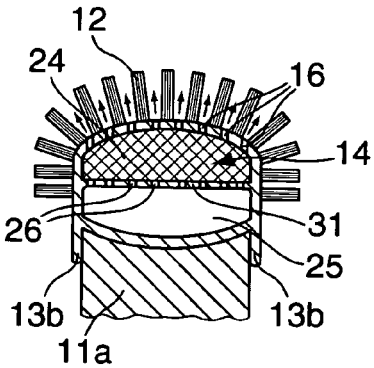
FIG. 31 shows a sectional view of a bristle carrier with cavity and storage region.

FIG. 30 shows an embodiment wherein a further dividing wall 13*d* extends between the inner wall of the bridge 13*b* of the bristle carrier 13 below the covering part 13*a* such that the cavity 14 is formed within the bristle carrier 13 between the upper covering part 13*a* and the lower dividing wall 13*d*. The further development shown in FIG. 31 is provided with a storage region 25 for a medium to be applied which is located below the cavity 14 in which a foamed insert 24 is disposed. The cavity 14 is separated from the storage region 25 by a dividing wall 31 provided with passages 26. The medium may flow from the storage region 25 through the passages 26 into the foamed insert 24 of the cavity 14 and is delivered therefrom to the bristles 12 via passages 16 in the upper covering part 13*a*.

Figure 32:
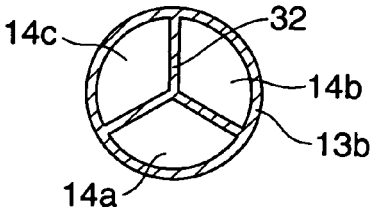
FIG. 32 shows a horizontal section through a bristle carrier comprising a multiple chamber cavity.

As shown in FIG. 32, the cavity 14 may be subdivided by inner dividing walls 32 into several separate chambers 14*a*, 14*b*, 14*c* which can accommodate various media which flow together and react following exit.

Figure 33:
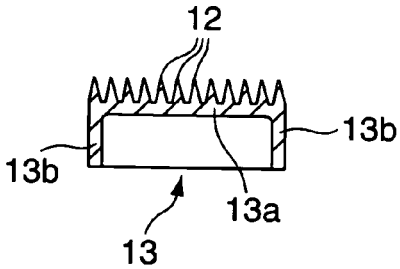
FIG. 33 shows a sectional view of a bristle carrier with injection-molded bristles.
Figure 34:
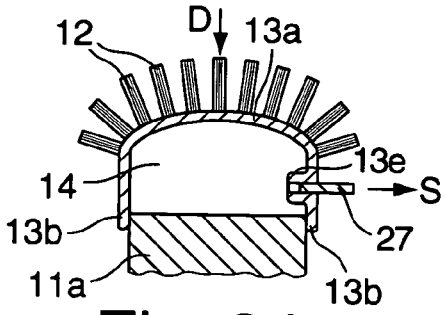
FIG. 34 shows a sectional representation of a bristle carrier with indicator element.

FIG. 33 shows an embodiment. The bristles are not pre-fabricated by a spinning method and then mounted to the bristle carrier, rather are produced in one piece therewith using a one-or two-component injection-molding process.

FIGS. 34 to 39*b* show various embodiments wherein the load-related pressure increase in the cavity 14 occurring during deformation of the bristle carrier 13 is indicated by an indicator. In accordance with FIG. 34 a displaceable piston 27 is disposed in a connection piece-shaped section 13*e* of the bridge 13*b* of the bristle carrier 13. When the user presses from the outside on the bristles 12 or the covering part 13*a* (arrow D), the volume of the cavity 14 is reduced and the inner pressure increases thereby pushing the piston 27 outwardly as indicated by arrow S in FIG. 34. The user can observe the pushed-out piston. The degree of displacement of the piston 27 indicates the inner pressure of the cavity 14 and thus the external pressure applied by the user. The displacement of the piston 27 can also serve for triggering further mechanical, acoustical and/or electrical signals.

Figure 35:
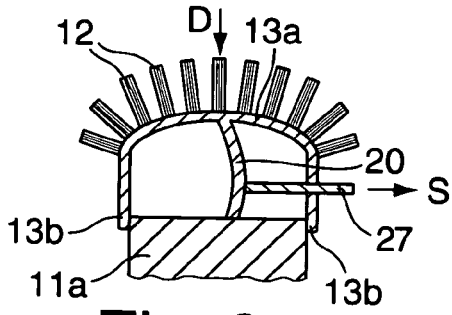
FIG. 35 shows an alternative embodiment of the bristle carrier in accordance with FIG. 34.

In accordance with FIG. 35, a support acting as spring 20 is formed on the lower side of the covering part 13*a* and is supported on the upper side of the projection 11*a*. Also in this case, a piston 27 is displaceably disposed in a passage of the bridge 13*b* which abuts with its inner end on the spring 20. If the user presses from the outside onto the bristles 12 or the covering part 13*a* (arrow D), the spring 20 is laterally deflected thereby outwardly displacing the piston 27, as shown by arrow S.

Figure 36A:
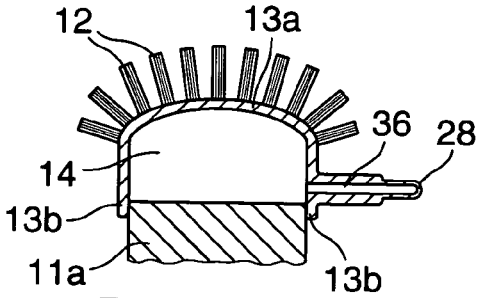
FIG. 36*a* shows a sectional representation of a bristle support with alternative indicator element in a first functional state.
Figure 36B:
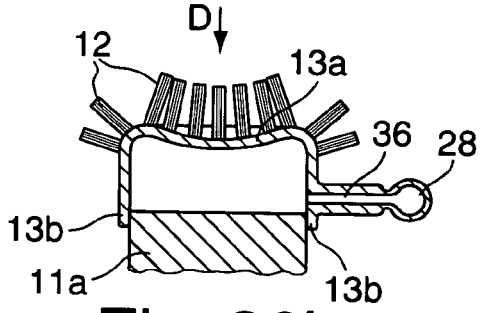
FIG. 36*b* shows a sectional representation of a bristle support with alternative indicator element in a second functional state.

In accordance with FIG. 36*a*, a thin-walled closing diaphragm 28 is formed on the outer side of a pipe socket-shaped passage 36 formed in the bridge 13*b* which, with increasing inner pressure, can be blown up like a balloon, as indicated in FIG. 36*b*, thereby providing an indication of the pressure applied by the user onto the bristles (arrow D).

Figure 37A:
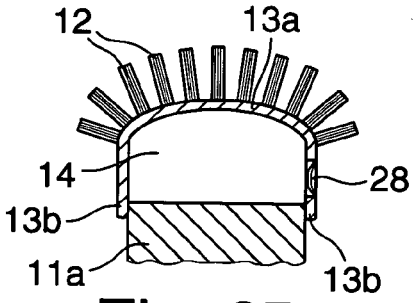
FIG. 37*a* shows a sectional representation of a bristle support with alternative indicator element in a first functional state.
Figure 37B:
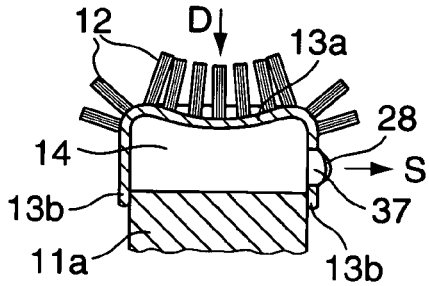
FIG. 37*b* shows a sectional representation of a bristle support with alternative indicator element in a second functional state.
Figure 38A:
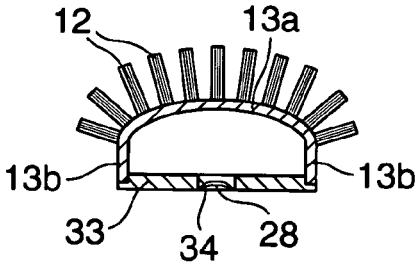
FIG. 38*a* shows a sectional representation of a bristle support with alternative indicator element in a first functional state.
Figure 38B:
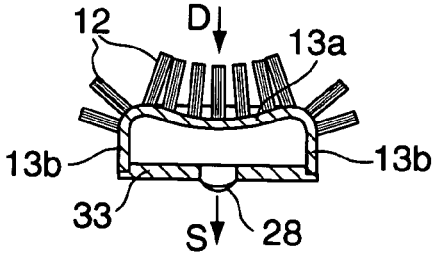
FIG. 38*b* shows a sectional representation of a bristle support with alternative indicator element in a second functional state.

In accordance with FIGS. 37*a* and 37*b*, a passage 37 is directly formed in the wall of the bridge 13*b* and sealed by a closing diaphragm 28 which can be expanded and—as shown in FIG. 38*b*—bulges outwardly with increased inner pressure in the cavity 14. Therein, the closing diaphragm 28 may be pre-fabricated as a separate structural part and then mounted in the passage 37. It is, however, also possible to injection-mold the closing diaphragm 28 on the bridge 13*b*, in one piece.

A similar closing diaphragm 28 may be formed in a passage 34 of a lid 33 closing the lower side of the bristle carrier 13 (FIG. 38*a*) which curves downwardly with increased inner pressure (FIG. 38*b*).

Figure 39A:
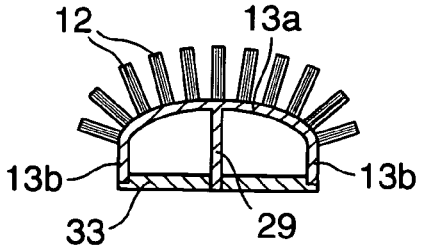
FIG. 39*a* shows a sectional representation of a bristle support with alternative indicator element in a first functional state.
Figure 39B:
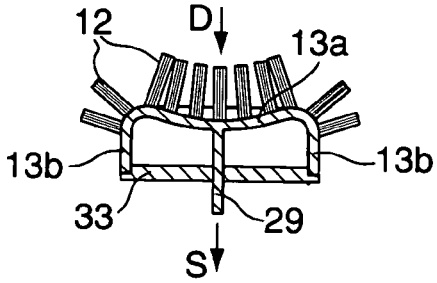
FIG. 39*b* shows a sectional representation of a bristle support with alternative indicator element in a second functional state.

In accordance with the embodiment of FIGS. 39*a* and 39*b*, an indicator bar 29 is displaceably guided in the lid 33 and is formed, at its upper end, on the covering part 13*a*. When the covering part 13*a* is downwardly deformed by application of external pressure, the indictor bar 29 is pushed downwardly out of the lid 33 (FIG. 39*b*) and can be directly used as a pressure indicator or, as described above, for triggering a corresponding signal.

Figure 40:
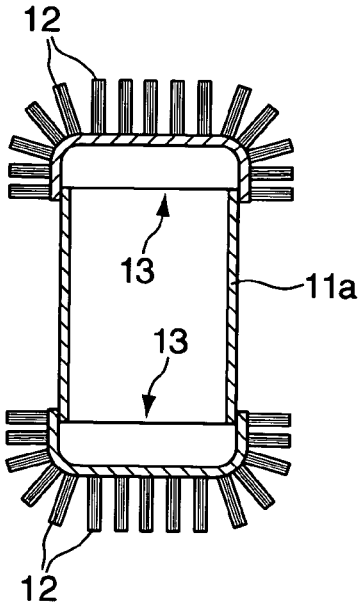
FIG. 40 shows a sectional view of a brush body with two attached bristle carriers.
Figure 41:
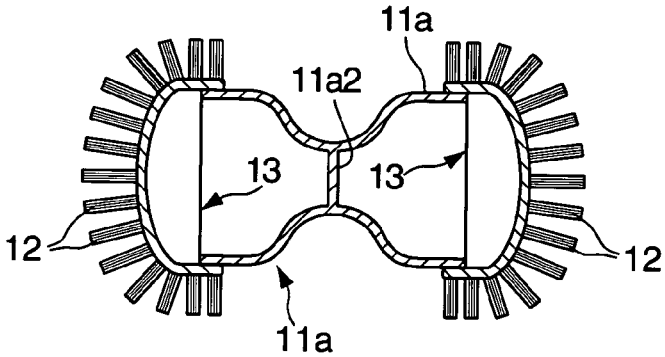
FIG. 41 shows a further development of the embodiment of FIG. 40.

FIG. 40 shows an embodiment with which one cap-like bristle carrier 13 is disposed on each of two different sides of a projection 11*a* of a brush body 11. If the inner space of the projection 11*a* in accordance with FIG. 41 is divided by a dividing wall 11*a*2 into two separate chambers, different media can be disposed therein to each be associated with one specific bristle carrier 13, such that the user can select the one or other medium depending on the orientation of the brush.

Figure 42A:
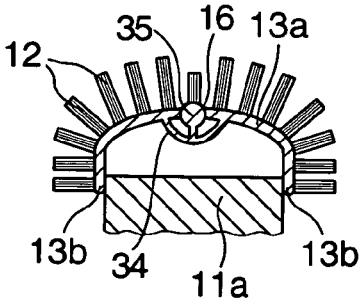
FIG. 42*a* shows a sectional representation of a bristle support with a valve in a first functional state.
Figure 42B:
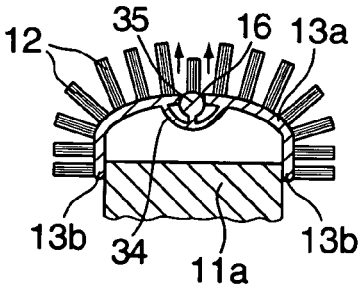
FIG. 42*b* shows a sectional representation of a bristle support with a valve in a second functional state.

In accordance with the embodiment shown in FIGS. 42*a* and 42*b*, a passage 16 is provided in the covering part 13*a* which can be closed or opened by means of an adjustable valve element 35. The valve element 35 is disposed on the lower side of the covering part 13*a* via a strap formed thereon as a single piece and can be adjusted between the closing and opening position under elastic deformation of the strap 34.

I claim:

1. A brush comprising:

a brush body having a projection;

a plurality of bristles;

a cap-shaped bristle support made from a soft-elastic plastic and supporting said plurality of bristles, said bristle support disposed over said projection for retention on said brush body, wherein said cap-shaped bristle support and said brush body are structured to define a cavity disposed between said bristle support and said brush body, wherein a dividing wall subdivides said cavity into separate chambers.

2. The brush of claim 1, wherein the brush is a tooth brush.

3. The brush of claim 1, wherein said cavity is delimited by said bristle support and said brush body.

4. The brush of claim 1, wherein a damping fluid is received in said cavity.

5. The brush of claim 1, wherein a medium to be applied is received in said cavity.

6. The brush of claim 5, wherein said bristle support defines at least one passage for said medium.

7. The brush of claim 1, further comprising a foamed insert disposed within said cavity.

8. The brush of claim 7, wherein said foamed insert is soaked with a medium to be applied.

9. The brush of claim 1, wherein a storage region for a medium to be applied is formed below said cavity and communicates with said cavity via at least one passage.

10. The brush of claim 1, wherein said bristle support is retained on said brush body in a removable fashion.

11. The brush of claim 1, wherein said bristle support is drawn over said projection of said brush body.

12. The brush of claim 1, wherein said bristle support comprises a covering part having a continuous peripheral bridge which is clamped onto said projection of said brush body from an outside.

13. The brush of claim 12, wherein at least some of said bristles are disposed, on an upper side of said covering part.

14. The brush of claim 12, wherein at least some of said bristles are disposed on an outside of said bridge.

15. The brush according of claim 1, wherein an upper side of said projection of said brush body has a surface structure, said bristle support being disposed onto said projection to abut against and follow said structure.

16. The brush of claim 12, wherein said covering part has a surface structure.

17. The brush of claim 1, wherein said brush body cap-shaped.

18. The brush of claim 12, wherein an inner side of said covering part is provided with at least one of projections and recesses.

19. The brush of claim 1, wherein at least one spring element, supported on said brush body, is formed on an inner side of said bristle support.

20. The brush of claim 12, wherein said bridge is axially flexible.

21. The brush of claim 20, wherein at least a portion of said bridge is formed as a bellows.

22. The brush of claim 12, wherein said bridge is elastically deformable in a radial direction.

23. The brush of claim 12, wherein said bridge comprises elastically deformable projections on an outer peripheral surface thereof.

24. The brush of claim 12, wherein said covering part projects laterally, radially beyond said bridge to thereby form a freely protruding edge section.

25. The brush of claim 1, wherein said brush support is held on said brush body in a non-rotatable fashion.

26. The brush of claim 12, wherein sealing elements are formed on an inner side of said bridge for engagement with corresponding recesses of said brush body.

27. The brush of claim 1, wherein said bristles are formed as one piece together with said bristle support.

28. The brush of claim 27, wherein said bristles are injection-molded.

29. The brush of claim 1, further comprising an indicator element adjustably disposed on said bristle support, wherein said indicator element can be actuated upon deformation of said bristle support.

* * * * *